United States Patent [19]

Gary

[11] Patent Number: 4,877,209

[45] Date of Patent: Oct. 31, 1989

[54] DECORATIVE LIGHT PEDESTAL

[75] Inventor: Lonnie F. Gary, Lubbock, Tex.

[73] Assignee: Gary Products Group, Inc., Lubbock, Tex.

[21] Appl. No.: 294,268

[22] Filed: Jan. 6, 1989

Related U.S. Application Data

[63] Continuation-in-part of Ser. No. 257,392, Oct. 13, 1988, abandoned.

[51] Int. Cl.[4] ..... A47F 5/00

[52] U.S. Cl. ..... 248/205.3; 248/314

[58] Field of Search ..... 248/205.3, 205.4, 314, 248/231.8, 316.7, 316.8, 254; 362/249, 457

[56] References Cited

U.S. PATENT DOCUMENTS

| | | | |
|---|---|---|---|
| 1,533,209 | 4/1925 | Radu | 248/314 X |
| 2,599,303 | 6/1952 | Ward | 248/231.8 X |
| 2,889,451 | 6/1959 | Longo | 248/314 |
| 3,189,310 | 6/1965 | Trueson | 248/314 |
| 3,193,229 | 7/1965 | Stock | 248/231.8 X |
| 3,219,812 | 11/1965 | Turner | 248/314 X |
| 3,504,169 | 3/1970 | Freeburger | 362/249 |
| 3,692,993 | 9/1972 | Robinson | 362/249 X |
| 3,713,614 | 1/1973 | Taylor | 248/205.3 X |
| 4,667,276 | 5/1987 | Cheng | 362/249 |
| 4,779,177 | 10/1988 | Ahroni | 362/249 X |

*Primary Examiner*—Ramon O. Ramirez

*Attorney, Agent, or Firm*—Ross, Howison, Clapp & Korn

[57] ABSTRACT

A decorative light pedestal adapted to receive and maintain the socket portion of a decorative bulb and socket assembly and bond said pedestal to a support surface, the pedestal comprising a circumferential socket support member, a base member defining a substantially planar mounting surface, and an adhesive means adapted to bond the mounting surface of the pedestal to the support surface.

2 Claims, 1 Drawing Sheet

DECORATIVE LIGHT PEDESTAL

CROSS-REFERENCE TO RELATED APPLICATION

This patent application is a continuation-in-part of U.S. application Ser. No. 07/257,392 filed Oct. 13, 1988.

TECHNICAL FIELD

This invention relates to decorative lighting, and more particularly, to apparatus for supporting and maintaining decorative lighting on a substantially planar surface. One aspect of the invention relates to a pedestal having a substantially cyclindrical support member adapted to receive and support the socket portion of a decorative bulb and socket assembly. Another aspect of the invention relates to a decorative light pedestal having a base member with an adhesive backing adapted to attach the pedestal to an underlying support surface.

BACKGROUND OF THE INVENTION

The use of ornamental lighting for holiday decorating is well known. Ornamental lighting is also useful in marketing displays and for creating special effects in commercial establishments. Strings of decorative lights comprising, for example, twenty-five, fifty, or one hundred individual sockets are typically wired together with strands of insulated, small-diameter wire to which a plug or plugs are attached at one or both ends to facilitate connection with an electrical energy source or another strand of lights. Clear or colored bulbs are inserted into the sockets to provide the desired lighting effect.

Problems have been encountered where the desired decorative lighting scheme requires the attachment of decorative light strings to a substantially planar support surface. Some have previously sought to overcome this problem by adapting decorative light holders to be maintained on a substantially planar support surface by screw-type fasteners, nails, or the like. One such light holder is disclosed in U.S. Pat. No. 3,189,310. The holder disclosed in U.S. Pat. No. 3,189,310 comprises a base portion and a substantially cylindrical wall having two oppositely disposed horizontal slots. A hole through the base is adapted to receive a screw for securing the holder to a window molding or the facia or eaves of a house. The slots are designed to accommodate the wires extending in either direction from the base of a light socket, and the inside surface of the cylindrical wall is said to taper inwardly at its open end to grip a decorative light socket.

Notwithstanding the decorative light holders previously disclosed, a holder is needed that can be used to mount decorative light bulbs on a substantially planar support surface without penetrating or otherwise damaging the surface. A decorative light holder is also needed that can support a decorative bulb attached to string of such bulbs in a preferred alignment with a support surface. A decorative light holder is also needed that can protect a decorative bulb and socket assembly, and minimize the possibility of unintentional disengagement of the bulb from the socket, without interfering with visibility during use. A decorative light holder is also needed that can be used selectively to mount a decorative light bulb and socket assembly in a position either parallel or perpendicular to the support surface.

Decorative light holders embodying the foregoing advantages are disclosed herein.

SUMMARY OF THE INVENTION

According to the present invention, a decorative light pedestal is disclosed that can be used to mount decorative light bulbs on a substantially planar support surface without penetrating or otherwise damaging the surface. A decorative light pedestal is also disclosed that can support a decorative bulb attached to string of such bulbs in a preferred alignment with a support surface. A decorative light pedestal is also disclosed that can protect a decorative bulb and socket assembly, and minimize the possibility of unintentional disengagement of the bulb from the socket, without interfering with visibility during use. A decorative light pedestal is also disclosed that can be used selectively to mount a decorative light bulb and socket assembly in a position either parallel or perpendicular to the support surface.

According to one preferred embodiment of the invention, a decorative light pedestal is provided that comprises a base member having a substantially planar mounting surface; a circumferential socket support member extending outwardly from the base member on the side of said base member opposite the mounting surface; a first void extending axially through the circumferential support member and the plane of the base member to permit a socket or bulb and socket assembly to be inserted into the circumferential support member from the side of the base member; a second void adapted to accommodate the passage of wiring connected to the socket after insertion of the socket into the circumferential support member; and an adhesive means adapted to bond the mounting surface of the pedestal to a substantially planar support surface after insertion of a socket or bulb and socket assembly into the pedestal.

According to another preferred embodiment of the invention, a decorative light pedestal is provided that comprises two perpendicularly disposed base members and mounting surfaces which enable the user to selectively mount the pedestal so that the longitudinal axis through the circumferential support member is either parallel or perpendicular to the support surface as desired.

According to another embodiment of the invention, the length and diameter of the circumferential support member can be such that a decorative bulb inserted therein is better protected from bumping, jarring and the like. With this embodiment of the invention, the circumferential support member is preferably made of a clear, rigid material such as acrylic resin.

BRIEF DESCRIPTION OF THE DRAWINGS

The apparatus of the invention is further described and explained in relation to the following figures wherein.

Like numerals are used to indicate like parts in all figures of the drawings.

DESCRIPTION OF THE PREFERRED EMBODIMENTS

Figure 1:
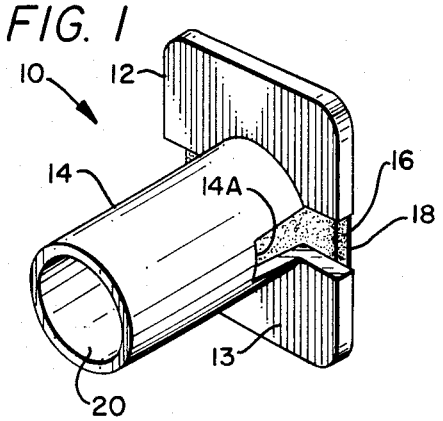
FIG. 1 is a front perspective view of one preferred embodiment of the apparatus of the invention.
Figure 2:
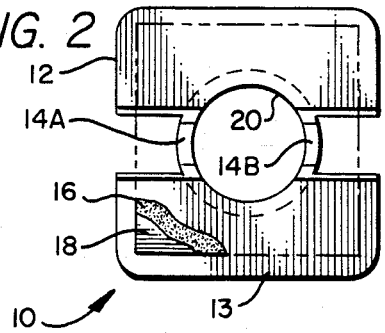
FIG. 2 is a rear elevation view, partially broken away, of the apparatus of FIG. 1.
Figure 3:
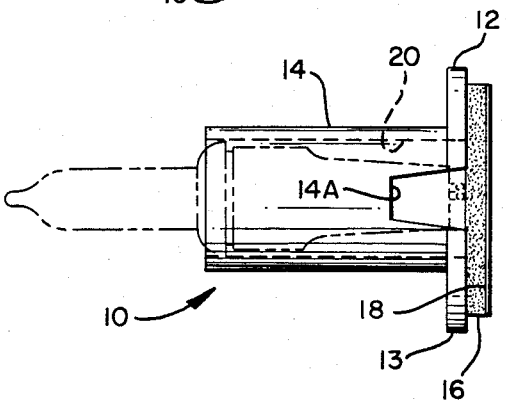
FIG. 3 is a side elevation view of the apparatus of FIG. 1, with a decorative bulb and socket assembly inserted into the decorative light pedestal of the invention being depicted in phantom outline.

Referring to FIGS. 1, 2 and 3, decorative light pedestal 10 preferably comprises base members 12, 13, circumferential support member 14, and adhesive means 16. A void extending through pedestal 10, including base member 13 and the lower portion of circumferential support member 14, is defined by walls 14A, 14B. This void is intended to accommodate the passage of wires connected to a decorative bulb and socket assembly, as shown in phantom outline in FIG. 3.

With this embodiment of the invention, the bulb and socket assembly are desirably inserted into bore 20 of circumferential support member 14 prior to securing adhesive means 16 to the mounting surface of base member 13. Although circumferential support member 14 and bore 20 are depicted herein as being cylindrical, it will be apparent upon reading this disclosure that support members having different cross-sectional shapes can be similarly utilized within the scope of the invention so long as as the interior space within the support member is adequate to accommodate the socket or bulb and socket assembly as desired. Thus, as used herein, the term 'circumferential' refers to the fact that the support member extends completely around the decorative socket, and does not imply that the geometry of the support member requires a circular cross-section.

Also, while the side walls of support member 14 are depicted herein as being continuous, with the exception of the void defined by walls 14A, 14B, it is understood that the pedestals of the invention can also comprise, for example, a lattice that extends circumferentially around the decorative light socket or bulb and socket assembly.

According to a preferred embodiment of the invention, circumferential support member 14 and base member 13 are unitarily molded, such as by injection molding, from a polymeric resin. Acrylic resin is particularly preferred for use in making the subject invention.

Adhesive means 16 preferably comprises a patch of polymeric foam impregnated with a releasable adhesive suitable for attaching the polymeric base member of pedestal 10 to an underlying support surface. Cover sheet 18 is adapted to be removed prior to attaching pedestal 10 to the support surface. Adhesive patches suitable for use in the invention are commercially available in various shapes and thicknesses, with various adhesives. An adhesive suitable for releasably attaching pedestal 10 to substrates including glass, wood, metal and masonry is preferred. The adhesive bond provided between decorative light pedestal 10 and the support surface should adequate to maintain the pedestal and decorative bulb and socket assembly in position throughout the range of conditions to be encountered during use, but will preferably release under the application of manual force if desired. Thus, if the user desires to remove pedestal 10 from the support surface following a period of use, adhesive means 16 should be removable from the support surface without scarring or otherwise damaging the surface. Similarly, adhesive means 16 is desirably removable from base member 16 so that pedestal 10 can be reused by attaching a new adhesive means 16 to base member 13 at another time.

Figure 4:
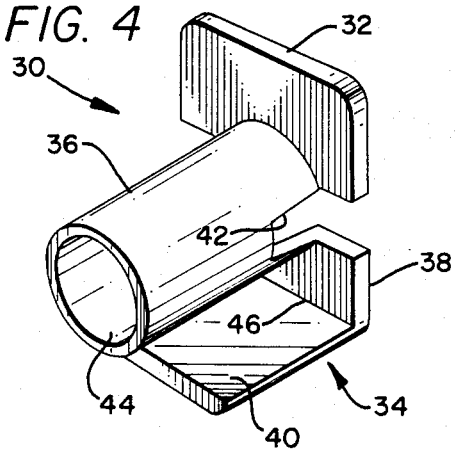
FIG. 4 is a front perspective view of another embodiment of the subject invention wherein the base portion of the decorative light pedestal comprises two perpendicularly disposed mounting surfaces.
Figure 5:
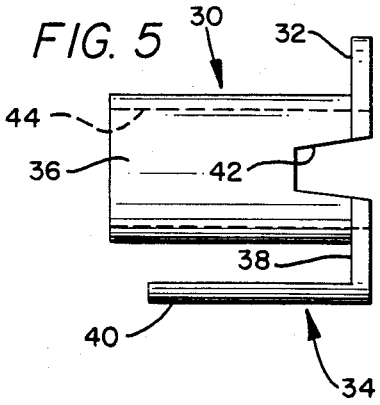
FIG. 5 is a side elevation view of the apparatus of FIG. 4.

Referring to FIGS. 4 and 5, another embodiment of the invention is depicted wherein decorative light pedestal 30 comprises base member 34 and circumferential support member 36. Circumferential support member 36 further comprises bore 44 and notch 42 adapted to accommodate a decorative light socket. Base member 34 preferably comprises spaced spaced apart sections 32, 38, defining a first mounting surface, and section 40 defining a second mounting surface. As shown, base section 38 and base section 40 intersect along line 46 and are perpendicularly disposed. When made in this configuration, decorative light pedestal 30 can be utilized to support a decorative bulb and socket assembly either parallel or perpendicular to the support surface. When the user desires to mount decorative light pedestal 30 using base section 40 as the mounting surface, the adhesive means should be attached to the side of section 40 opposite support member 36 rather than to base sections 32 and 38. Since adhesive means 16 as shown in FIGS. 1, 2 and 3 also serves the purpose of retaining the socket assembly inside the pedestal, however, it will be desirable to cover the gap between base sections 32 and 38 with another material such as transparent adhesive tape after the socket is inserted when using base section 40 as the mounting surface.

While base section 40 is shown as being substantially perpendicular to base sections 32, 38 in FIGS. 4, 5, it will be apparent that other angles can also be utilized for particular purposes or applications.

Figure 6:
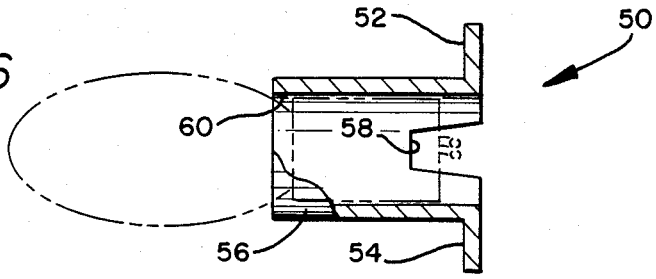
FIG. 6 is a side elevation view, partially broken away, of a decorative light pedestal similar to that depicted in FIGS. 1, 2 and 3, but adapted for use with a larger diameter bulb, which is shown in phantom outline.

Referring to FIG. 6, an embodiment of the invention is shown wherein pedestal 50 comprises base sections 52, 54 and circumferential support section 56. Circumferential support section 56 further comprises bore 60 and a void defined by walls 58. This embodiment, as with the embodiment shown in FIG. 3, depicts the free end of the circumferential support member as being substantially coextensive with the end of the decorative light socket when inserted therein. In FIG. 6, support member 56 cannot extend outwardly from base sections 52, 54 sufficiently to also cover the decorative bulb, because the bulb diameter exceeds that of bore 60.

However, with a bulb and socket assembly as shown in FIG. 3, it will be apparent that support member 14 can be made long enough to protect and support the bulb as well as the socket assembly. In such case, it is preferable that support member 14 be made of an optically transparent resin.

Other alterations and modifications of the subject invention will become apparent to those of ordinary skill in the art upon reading this disclosure, and it is intended that the scope of the invention be limited only by the broadest interpretation of the appended claims to which the inventor may be legally entitled.

What is claimed is:

1. A decorative light pedestal adapted to receive and maintain the socket portion of a decorative bulb socket assembly and bond said pedestal to a support surface, said pedestal comprising a base member having a substantially planar mounting service; a circumferential socket support member extending outwardly from said base member on the side of said base member that is opposite said mounting surface; and adhesive means adapted to bond said mounting surface of said pedestal to said support surface;

said pedestal further comprising a first void extending axially through the circumferential support member and the plane of the base member to permit said socket assembly to be inserted into the circumferential support member through said base member, and a second void adapted to receive and accommodate the passage of wiring connected to said socket assembly through said circumferential support member after said socket assembly is inserted therein;

said base member further comprising spaced apart sections which cooperate to define the plane of said mounting surface.

2. A decorative light pedestal adapted to receive and maintain the socket portion of a decorative bulb socket assembly and bond said pedestal to a support surface, said pedestal comprising a base member having a substantially planar mounting service; a circumferential socket support member extending outwardly from said base member on the side of said base member that is opposite said mounting surface; and adhesive means adapted to bond said mounting surface of said pedestal to said support surface;

said pedestal further comprising a first void extending axially through the circumferential support member and the plane of the base member to permit said socket assembly to be inserted into the circumferential support member through said base member, and a second void adapted to receive and accommodate the passage of wiring connected to said socket assembly through said circumferential support member after said socket assembly is inserted therein;

said base member further comprising spaced apart section which cooperate to define the plane of said mounting surface, and an additional base section disposed in substantially perpendicular relation to said spaced apart sections, said additional base section defining a second mounting surface substantially parallel to said axially extending first void through said circumferential support member.

* * * * *

UNITED STATES PATENT AND TRADEMARK OFFICE

CERTIFICATE OF CORRECTION

PATENT NO. : 4,877,209

DATED : OCTOBER 31, 1989

INVENTOR(S) : LONNIE F. GARY

It is certified that error appears in the above-identified patent and that said Letters Patent is hereby corrected as shown below:

On title page

On face of patent, Related U.S. Application Data:

Delete [ , abandoned ]

Signed and Sealed this

Twenty-sixth Day of March, 1991

*Attest:*

HARRY F. MANBECK, JR.

*Attesting Officer*

*Commissioner of Patents and Trademarks*